US005400765A

United States Patent [19]

Goldstein et al.

[11] Patent Number: 5,400,765

[45] Date of Patent: Mar. 28, 1995

[54] SELECTIVE EMISSIVE COOKING STOVE

[75] Inventors: Mark K. Goldstein, La Jolla; Leo Block, San Clemente, both of Calif.

[73] Assignee: Quantum Group, Inc., San Diego, Calif.

[21] Appl. No.: 176,013

[22] Filed: Dec. 28, 1993

Related U.S. Application Data

[63] Continuation-in-part of Ser. No. 636,132, Dec. 31, 1990, Pat. No. 5,281,131, is a contiuation-in-part of Ser. No. 864,088, May 16, 1986, abandoned.

[51] Int. Cl.[6] ..... F24C 3/00

[52] U.S. Cl. ..... 126/39 J; 126/214 R; 126/91 R; 431/326; 431/253; 431/351

[58] Field of Search ..... 126/39 J, 214 R, 91 R, 126/92 AC, 92 R, 39 H; 431/325, 326, 327, 328, 344, 344, 352, 320, 351, 165, 253

[56] References Cited

U.S. PATENT DOCUMENTS

| | | | |
|---|---|---|---|
| 4,059,385 | 11/1977 | Gulitz et al. | 431/12 |
| 4,067,681 | 1/1978 | Reid, Jr. et al. | 431/10 |
| 4,201,184 | 5/1980 | Scheilder et al. | 126/39 J |
| 4,597,734 | 7/1986 | McCausland et al. | 431/328 |
| 4,776,895 | 10/1988 | Goldstein | 431/100 X |
| 4,793,799 | 12/1988 | Goldstein et al. | 431/79 |
| 4,906,178 | 3/1990 | Goldstein et al. | 431/79 |
| 4,906,179 | 3/1990 | Nitta | 431/264 |

*Primary Examiner*—Larry Jones
*Attorney, Agent, or Firm*—Christie, Parker & Hale

[57] ABSTRACT

In a gas-fired stove or oven, gas is burned in a porous ceramic surface combustion burner which generates selective emissive radiation in a narrow band. The high temperature surface of the burner includes a narrow band quantum emitting substance such as rare earth metal oxide. Relatively shorter wavelength radiation from this quantum emitting surface illuminates process targets having an absorption spectrum nearly matched to the emission spectrum of the burner surface, for a variety of applications such as cooking. The selected emission may be passed through a glass top stove to heat a pot with an absorptive bottom or may pass on through a glass pot to heat the food directly.

29 Claims, 6 Drawing Sheets

SELECTIVE EMISSIVE COOKING STOVE

CROSS REFERENCE TO RELATED APPLICATIONS AND DISCLOSURE DOCUMENTS

This application is a continuation-in-part of patent application entitled Selective Emissive Burner, Ser. No. 07/636,132, filed Dec. 31, 1990, now U.S. Pat. No. 5,281,131 which is a continuation-in-part of patent application Ser. No. 06/864,088, filed May 16, 1986 (now abandoned). The application is related to patent applications Ser. No. 07/057,902 filed Jun. 2, 1987, now U.S. Pat. No. 4,776,895 and Ser. No. 07/216,286 filed Jul. 6, 1988 and now U.S. Pat. No. 4,906,178. It is also a continuation-in-part of patent application Ser. No. 07/860,777 filed Mar. 27, 1992 now U.S. Pat. No. 5,356,487. It is also a continuation-in-part of U.S. patent application Ser. No. 07/048,961 filed May 11, 1987, now U.S. Pat. No. 4,793,799 which is a continuation of U.S. patent application Ser. No. 06/659,074 filed Oct. 5, 1984 (now abandoned) which was a National application corresponding to International Application No. PCT/US84/01038 filed Jul. 3, 1984, which was a continuation-in-part claiming priority of U.S. patent application Ser. No. 06/517,699 filed Jul. 25, 1983 (now abandoned).

The application is also related to Disclosure Document No. 156,490 filed on or about Sep. 22, 1986, and Disclosure Document No. 167,739 filed Apr. 13, 1987, No. 239577 received Nov. 16, 1989, and apparently renumbered by the U.S. Patent and Trademark Office as Disclosure Document No. 168,234. The subject matter set forth in these prior applications and disclosure documents is hereby incorporated by reference.

BACKGROUND OF THE INVENTION

Thermocouples have long been used in gas fueled appliances for the generation of a small amount of electric current to power a simple control system or a pilot safety shut-down system. The use of thermocouples does not economically permit generation of sufficient power for operation of a blower, pump or other equipment related to the operation of the gas appliance.

This invention relates to burners containing narrow band selective emitters on their emissive surface(s) which is the subject of the original application. The radiant energy may be used in a variety of applications such as gas range and oven cooking by matching the near infrared emission of selected super-emitters to the absorbivity of the food being cooked. The key to the use of these devices is that any surfaces that the energy transcends must transmit a large portion of the selected emissions.

Currently gas cooking equipment is unvented and it often creates pollution in the home or commercial facility. In addition, an open flame is often the cause of fires, injuries, and even worse. The move to energy conservation after the first oil shock and the continuing rise in energy cost has lead to new construction techniques and retrofits that make commercial building, factories and dwellings nearly air tight. Thus, there is a need for radiant cooking with lower pollution emissions and a need for efficient energy use such as is possible with selective emitters. Other devices that use selected photon wavelengths can also be constructed on this same principle e.g. photochemical reactors.

In addition to the generation of heat, a gas flame has been used to provide other forms of energy.

Thermocouples have long been used in gas fueled equipment to generate electric power for a flame failure shut down system and for the operation of a simple gas control system. However, the power generated by thermocouples is insufficient to economically power blowers, pumps or other equipment related to the operation of the gas fueled equipment.

The gas flame can also provide the source of radiant energy for generation of electric power by means of a photovoltaic device. U.S. Pat. No. 3,188,836 by Kniebes describes an emissive radiation arrangement to power a control valve for a gas lamp. This, in effect, is a replacement for a thermocouple.

U.S. Pat. No. 3,331,701 by Werth provides the first known description of a thermophotovoltaic power producing device using silicon cells. The efficiency of silicon solar cells has been optimized to produce electric power with an efficiency of about 2.6% using a tungsten filament heated to about 2200° K. as the heat source. This would be no more than marginally suitable for a self-powered gas fired appliance as provided in practice of this invention.

U.S. Pat. No. 4,906,179 by Goldstein, et al., describes the use of selective emissive burner in self powered appliances. A thermophotovoltaic power generation system provides up to 40% conversion of fuel energy into electric power to make self powered gas appliances feasible. This high level of conversion into electric power is attained by the use of a gas fired burner constructed of superemitting materials that emit radiant energy that is primarily of the same wavelength as the absorbtivity of the photovoltaic cell.

This basic invention pertains to the use of a burner capable of emitting narrow band radiation that can be used for a variety of applications and specifically pertains to a gas range and cooking oven for residential and commercial kitchen equipment.

Currently, gas cooking equipment is mostly unvented. This usually results in pollution from combustion products in the home or commercial kitchen. Also, the open flame presents a danger of fire, burns and even carbon monoxide poisoning. This situation is aggravated e.g. by the recent trend of constructing homes tighter to reduce the cost of heating the home. The tight construction results in a reduction of infiltration air and results in a higher concentration of pollution emitted from the cooking equipment. Thus, there exists a need for a reduction in emissions from gas fired cooking equipment.

In an attempt to reduce the pollution associated with gas cooking, several patents have been issued for a "gas under glass" arrangement in which the burner, or burners, are located under a high temperature ceramic glass panel that constitutes the top surface of the cooking equipment. The pots and pans that contain the food to be cooked are placed directly on the ceramic glass panel and immediately above the burners located below the panel. The main attraction of this arrangement is any food spilled on the panel can be readily wiped up. On a conventional gas fired cook top, spilled food falls directly on the burner. This tends to clog burner pots and results in safety hazards and a complex and time consuming cleaning chore. However, the complexity in the implementation of this "gas under glass" concept is that (1) the maximum allowable working temperature of the ceramic glass panel must not be exceeded, and (2) a high magnitude of energy is needed to reduce the cooking time to a practical minimum.

U.S. Pat. No. 4,067,681 of Reid, et. al. pertains to a "gas under glass" smooth top range. The gas burner discharges combustion products into a spiral combustion chamber that consists of a grooved flue product passage cut into a fibrous refractory material. The top surface of the flue passage is the ceramic glass panel. The combustion chamber sides and bottom surfaces are heated to incandescence by the flue products and broad band infrared energy radiated through the glass panel. Heat is transferred by both "conduction and radiation through the glass/ceramic plate." Transfer of heat by conduction and radiation reduces the temperature of the glass as compared to transfer of heat solely by conduction. However, infrared radiation is broad band and therefore a large fraction of photons emitted are absorbed in heating the glass (ceramic). This arrangement has two additional disadvantages: (1) As a significant portion of the heat is transferred by conduction, the bottom surface of the cook pot must be true (perfectly flat) to insure satisfactory heat transfer between the ceramic or glass panel and the bottom of the cook pot; and (2) Although a blower is utilized, the combustion products are discharged into the kitchen.

U.S. Pat. No. 4,201,184 by Scheidler et. al. is also for a "gas under glass" cooking stove that utilizes a broad band infrared burner. Because the radiation is broad band and allows the glass to absorb heat, this patent calls for an elaborate temperature sensing and gas control system to prevent overheating of the glass.

BRIEF SUMMARY OF THE INVENTION

This invention differs from other "gas under glass" products in that the burner emits primarily a narrow wavelength band that is compatible with the absorbtivity of the food and the water in which the food is cooked. About 78% of the radiant energy is transmitted through a ceramic glass panel that is largely transparent to radiation in the narrow band emitted by the burner and this results in minimum heat absorption by the glass and allows for a maximum release of energy (for faster cooking) without overheating of the glass and without the need of an elaborate temperature sensing and control system to protect the glass.

An exemplary gas fired stove has a porous matrix burner including an emitting material on at least its outer surface that emits radiation in a narrow wavelength band. Combustible gas and air are supplied to the porous matrix burner for combustion in the porous matrix. A cooking top adjacent to the burner is transparent to at least a band of radiation corresponding to the narrow band of radiation emitted by the burner so that radiation passes through without significantly heating the cooking top. The radiation may also pass through the bottom of a transparent cooking vessel for heating food directly.

An increase in selective radiation can be attained by preheating the gas-air mixture prior to combustion. This invention presents several design arrangements in which flue products are utilized for recuperation, i.e., utilizing the energy in the exhaust product to preheat fuel and/or air. However, excessive preheating may lead to flame flashback through the burner head. To prevent this condition when maximum preheating is desired, this invention also provides a fuel injection arrangement in which the preheated air and fuel are brought together at or near the point of combustion.

Also presented is an oven arrangement in which the food to be cooked receives selective radiation directly from a burner mounted above the food or through a glass tray from a burner mounted below.

As all arrangements employ the use of a combustion air blower, a vent connection is provided to permit the discharge of combustion products to the outdoors.

DETAILED DESCRIPTION

Figure 1:
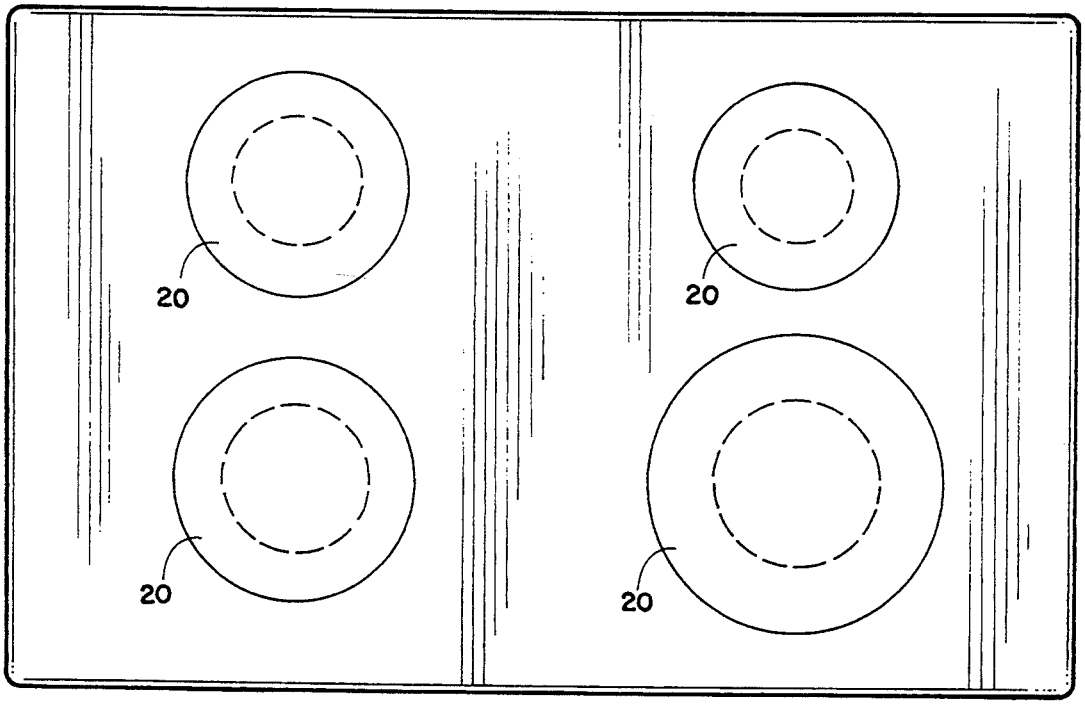
FIG. 1 Is a top view of a smooth top gas range within which any of the embodiments of the invention may be included.

FIG. 1 illustrates a smooth top gas range in which a continuous ceramic glass panel 10 provides a smooth top surface for receiving cookpots. Four selective emission burners 20 are located under the ceramic glass panel. Additional burners are located in the oven areas and cannot be seen in FIG. 1.

Figure 2:
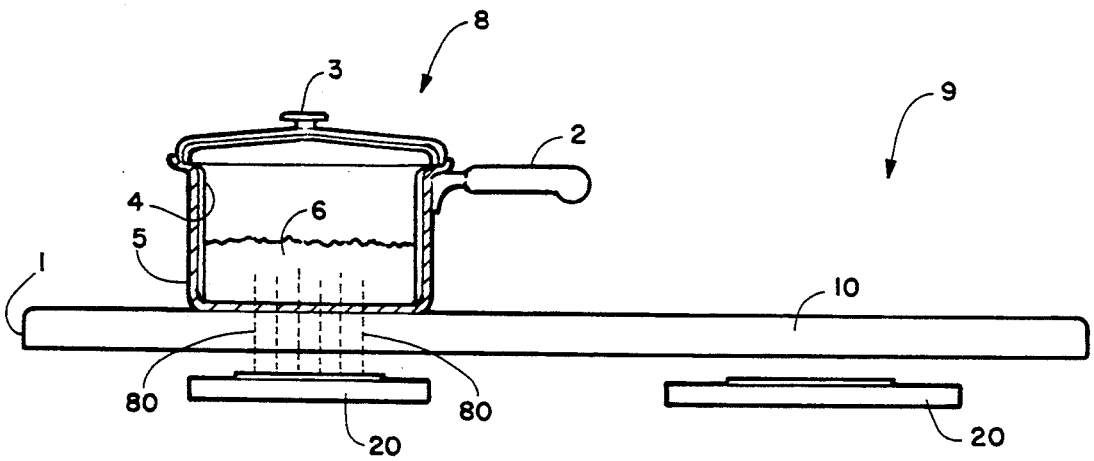
FIG. 2 Is a vertical section drawing at 2—2 of FIG. 1 with a cook pot shown on the ceramic glass surface.

FIG. 2 is a vertical section at line 2—2 of FIG. 1 showing the selective emissive burner 20 radiating energy 80 of a selected wavelength that permits 78% (or more) of the radiant energy to pass through the ceramic glass and through the glass bottom surface of a glass cook pot 5 directly to the water or food 6 inside the pot.

Figure 13:
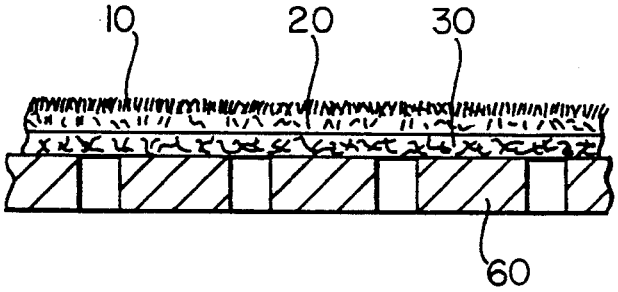
FIG. 13 Is a schematic cross section of a porous fiber matrix burner for the stove.

FIG. 13 illustrates the general structural features of a flat porous ceramic burner 20 for use in practice of the invention. The porous ceramic burner comprises a base fiber layer 30, an intermediate fiber layer 40, an outer fiber layer 50, and a burner skeleton 60, which may be a metal screen, perforated metal, porous ceramic or other suitable support material with one or more layers of fiber applied onto the skeleton.

The base fiber layer may comprise a high temperature fiber such as pure or doped oxides of uranium, thorium, ytterbium, aluminum, gallium, yttrium, erbium, holmium, zirconium, chromium or other high-temperature oxides. The base fiber layer is preferably any low-cost, fiber material that can be bonded effectively, preferably with thermally stimulated superemitter materials. One of the preferred base fiber layers is of aluminum oxide, which is inexpensive and which lasts longer under oxidative conditions than do other inexpensive materials such as carbides, silicon oxide, or aluminosilicates.

The intermediate layer functions to bond the outer fiber layer to the inner fiber layer. The intermediate fiber layer may be used when aluminum oxide fibers are used for the base fiber layer, and ytterbia is used as the outer fiber layer, since it is difficult to maintain a bond between ytterbia and alumina after thousands of cycles. If fibers other than aluminum oxide, such as yttria, are used for the base fiber layer, the intermediate layer may be omitted. When the intermediate layer is used, it preferably comprises any fiber material which is oxidation resistant and which bonds well to both alumina and ytterbia or alumina and holmium or mixed oxide fibers containing these materials or other suitable materials such as pure or doped uranium, thorium, ytterbium, gallium, yttrium, erbium, holmium, zirconium, chromium or other high-temperature oxide fibers.

The outer fiber layer is preferably a high-temperature superemissive material. The superemitter comprises a material which has an inner electron shell vacancy wherein upon heating one inner electron below jumps into the hole as described in U.S. Pat. Nos. 4,906,178; 4,793,799 and 4,776,895, i.e., perhaps by means of a photon-electron interaction. These patents are herein incorporated by reference.

Materials suitable for use as a narrow band superemitter are zirconium, yttrium, ytterbium, holmium, thulium, cerium or thorium oxide fibers, or thoriumholmium, aluminum ytterbium-yttrium mixed oxide fibers, or mixtures thereof or other materials that emit radiation by an inner electron shell transition. The use of such materials increases the life, reduces corrosion, and changes the emissivity characteristics of the resultant burner to those desired for transmission of radiation through the ceramic glass top of the stove and absorption by food.

Fiber for the burner may be manufactured or purchased. One manufacturing process is incorporated by reference from U.S. Pat No. 4,758,003. The size of the fibers may be from less than 1 $\mu$m to over 100 $\mu$m in diameter. Smaller-diameter fibers are preferred for some applications, since they are more rapidly heated and cooled than are larger-diameter fibers.

For example, to make alumina fiber a solution may be formulated with aluminum nitrate. To make superemitting fibers, a solution of ytterbium nitrate, yttrium nitrate, alumina and erbium nitrate are prepared. Any of the rare earth metal or other metal nitrates may be used in appropriate proportions to result in the desired compositions for a particular application.

Preferably, cut rayon fibers are impregnated with a solution that has concentrations of about 1 mg/ml comprising from about 80% to about 99.89% (wt/wt) $Yb(NO_3)_3.6HO_2$, from about 0% to about 3% $Er(NO_3)_3$, from about 0% to about 5% $Al(NO_3)_3$, and from about 0% to about 8% $Y(NO_3)_3$.

When the fibers are saturated, they are dried and then are treated with ammonia gas to reduce the nitrates. The ammonia reacts with the nitrate to form the hydroxide at about 25° C. (+5°) and 20% to 80% relative humidity for several hours. In order to carbonize the rayon, the cut fibers are first dried and heated to about 60° C. then fired at several hundred degrees to slowly oxidize the carbon containing metal to gaseous products.

The fibers are added to a specially prepared gel which serves as a ceramic binder and a transport medium for the vacuum or pressure forming process. One method for gel preparation used to suspend MMA (methylmethacrylate) and alumina fibers is from an alumina "sol," which is partially reacted with $Al(NO_3)_3$ to form a viscous gel. The viscosity of this gel is important. The gel must be thick enough to suspend a relatively-large-porosity agent that is used in formulating the burner material. If the gel is too thick, it will entrap air bubbles, thereby producing burners of poor quality. Preferably, the viscosity is maintained so as to just suspend the fibers and MMA.

The skeleton structure is then attached to a vacuum source. The screen is dipped into a fiber suspension, and about 2 to 8 cm Hg of vacuum is applied to "pull" the suspension onto the screen. A positive pressure can be used as long as there is sufficient pressure to provide aggregation of fiber and porosity agent and allowing the liquid to be pumped through. The vacuum pulls the fluid through the burner skeleton, while the screen acts like a filter. The fibers and the MMA are trapped on the surface of the burner blank, forming an alumina base layer. Most of the excess gel is drawn through the screen and captured in a separation tank.

The skeleton coated in the base fiber layer is removed from the gel suspension and allowed to air-dry. The vacuum is maintained for about 10 to 15 seconds or more, to aid in the drying process. The used gel solution may be replenished by adding the appropriate amount of fiber and porosity agent.

Alumina fibers, which in this embodiment of the invention form the base fibers of the burner, may be replaced with any fiber that can be mechanically or chemically bonded directly to ytterbia fibers, such as ceria, yttria, yttria alumina garnet, YAG, or mixed oxide fibers. If fibers other than alumina fibers are used, which bond directly to ytterbia, holmium, ceria/thoria, or mixtures thereof, then the step of adding yttria fibers, which in this embodiment of the invention form the intermediate fiber layer of the burner, and which are described below, may be omitted.

The next step is to bond a thin layer of yttria fibers, which form the intermediate fiber layer, to the alumina fiber layer. The intermediate fiber layer provides a means of bonding the ytterbia fibers, the outer fiber layer, to the alumina fibers. A thin layer, about 0.1 to 1 mm, of yttria fibers is then formed onto the alumina base fibers by drawing an yttrium hydroxide gel through the burner in the same manner as described for the alumina gel.

An alternative to using fibers such as yttria or a base layers is to coat the base fibers, such as alumina, with yttria or a layer of yttria and another layer of the emitting material, such as ytterbia containing material. Then the outer layer of fibers will bond to the coated base fiber. The process to coat the base fiber with one or more layers to enhance bonding of the outer fiber involves the use of soluble nitrate to coat the fiber by spray, dip or similar process. This coating is followed by drying and then a denitration process such as exposure to ammonia to form the hydroxide. The hydroxide is insoluble and may be bonded to directly, or the hydroxide may be partially or completely converted to the oxide first.

The next step is to form the outer fiber layer. The burner skeleton containing alumina base and/or yttria intermediate fiber layers is immersed in a gel containing ytterbia fibers as described above for the alumina fiber layer. After a few seconds, a layer of from about 2 to about 2.5 mm ytterbia fibers is formed, completing the porous ceramic fiber matrix. The outer fiber layer is preferably from about 1.5 to about 3.5 mm thick.

The porous ceramic fiber matrix is dried at from about 60° C. to about 80° C. Once dry, the porous ceramic fiber matrix is heated to about 320° C., to sublime the porosity agent. After about 90% or more of the porosity agent is removed (from about 1 to about 5 hours, depending on the size of the burner and the size of the porosity agent used), the temperature is slowly raised to about 500° C., to set the ceramic binder. The outer ceramic may be heated to over 1500° C., to "set" the colloidal ytterbia. The heating may be accomplished with a torch or other suitable means, such as burning gas on the burner surface.

The narrow band emitter or emitters selected for the outer layer has an emission line or lines that fall in a narrow wavelength band of the spectrum where the glass top of the stove is transparent. Such narrow band radiation is, however, absorbed by the water or food in a cooking pot or by a pot on the stove. Preferably, the cook pot is also made of glass transparent to radiation in the narrow band emitted by the burner so that the radiation heats food directly by absorption of radiation. Instead, such a pot may be made with a bottom that absorbs radiation and conducts heat to the food therein.

Figure 3:
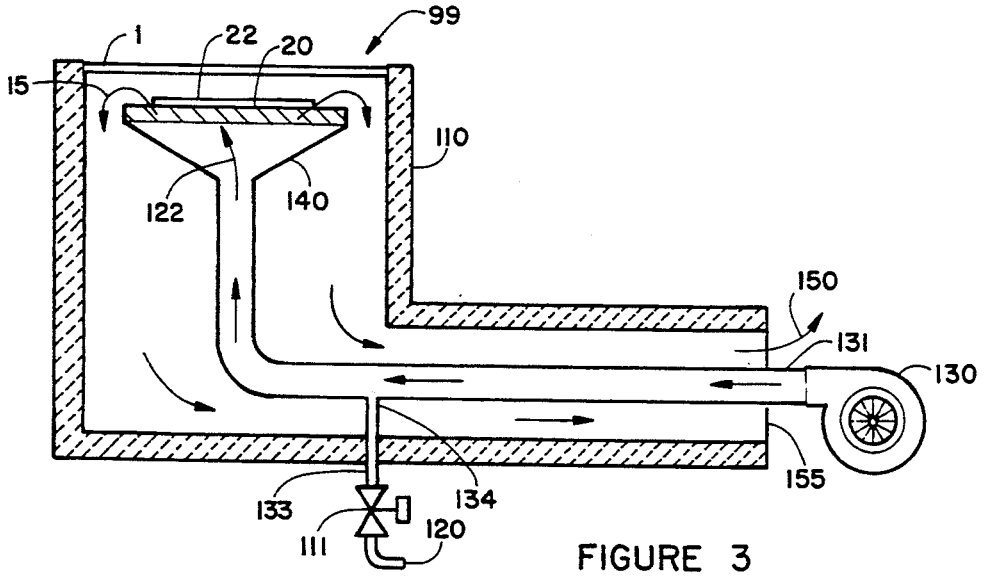
FIG. 3 Illustrates schematically one simplified embodiment of the invention showing the relative locations of major components and the flow of air, gas and flue products and regeneration.

FIG. 3 shows an exemplary embodiment of the invention in which a blower 130 discharges combustion air into a recuperator tube 131. A gas control 111 and gas line 133 admit gas to the burner inlet. Combustion air preheated in the recuperator tube by the flow of combustion products 15 outside the tube also flows through the burner inlet. The air-gas mixture is further heated in the burner head 140 by the combustion products flowing around the burner head and burner tube. Combustion of the gas-air mixture takes place on the top surface 20 of the burner head 140.

The top surface of the burner head is a porous fiber matrix that permits the flow of the gas-air mixture. Combustion of the gas-air mixture on the fiber matrix surface heats specific ingredients included in the fiber matrix to provide the desired selective emission that pass through the ceramic glass 10. The combustion products are exhausted through vent connection 155 that may be connected to a vent pipe terminating outdoors.

The desired radiation can be increased by preheating the air and/or air-gas mixture prior to combustion. In this arrangement, preheating is accomplished by heat transfer from the exhausting flue products (recuperation). Insulation 110 prevents any significant transfer of heat from the exhausting flue products into the kitchen.

Figure 4:
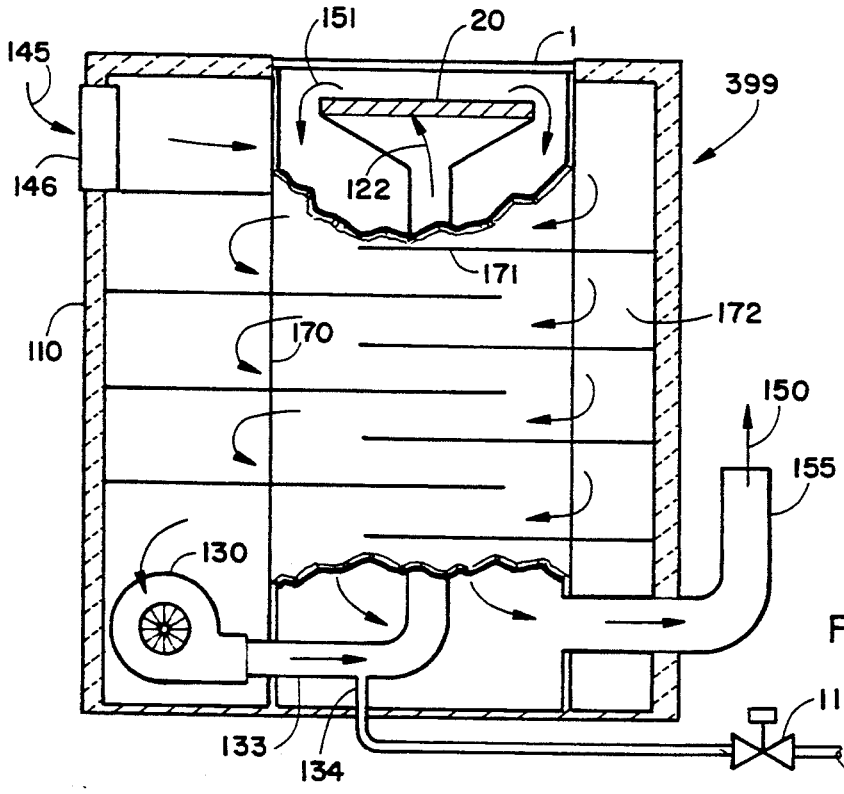
FIG. 4 Is similar to FIG. 3, except that a greater degree of recuperation is attained by preheating the combustion air before it enters the burner.

FIG. 4 illustrates an arrangement where the entire surface of the flue product conduit 170 is utilized as a heat transfer surface to preheat the combustion air before it enters the blower. Horizontal baffles 171 are utilized to define a circular flow path about the flue product conduit 170 to increase the flow velocity of the incoming air to increase heat transfer from the exhausting flue products to the incoming air. The additional heating of the air results in a greater rate of selective radiation from the burner and a lower flue outlet temperature; thus, greater over-all efficiency.

Minimum thickness insulation 110 prevents overheating of the kitchen area. A filter 146 prevents entry of foreign matter that may adversely effect the operation of the burner.

Figure 5:
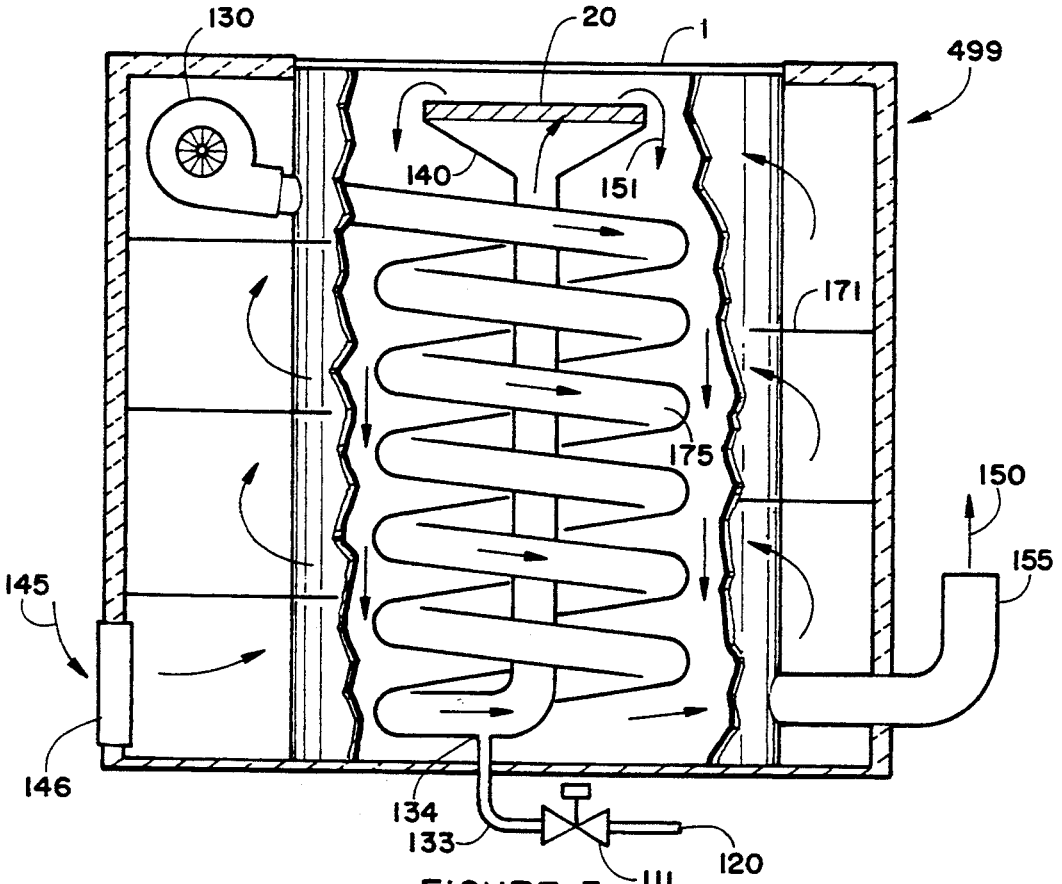
FIG. 5 Is similar to FIG. 4, except that a spiral recuperation tube is added to increase air preheating.

FIG. 5 illustrates an embodiment with a spiral recuperative tube 175 that is substantially longer than the recuperative tube 131 of FIG. 3. The increased tube length provides a greater heat transfer area for still more recuperative effect to further improve selective emission and over-all efficiency.

Figure 6:
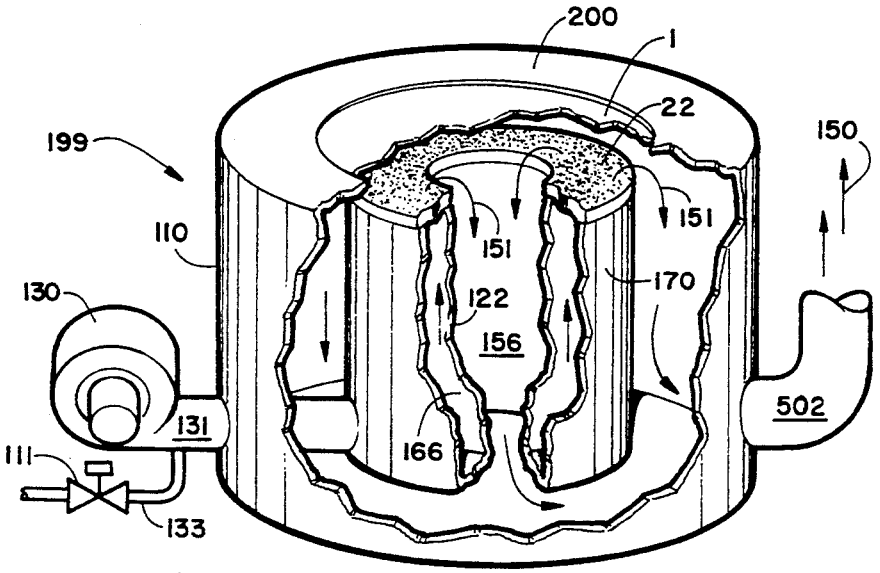
FIG. 6 Is another embodiment of this invention in which the recuperator is, in effect, built into the burner.

FIG. 6 shows a burner with a flue outlet passage 156 at the center of the burner and another flue outlet passage 157 about the outer perimeter of the burner. This results in economy of structure as the same metal surfaces are used to convey flue products (flowing to the vent attachment) and the air-gas mixture flowing to the burner head. As heat is transferred from the flue products to the air-gas mixture the burner also functions as a recuperator.

In this arrangement air from blower 130 enters the recuperator tube 131 and joins with the gas supplied by gas control 111 and gas line 133. This air-gas mixture is heated by the flue products that flow around recuperator tube 131. The air gas mixture flows into the annular space 166 formed by the burner's circular inner wall 122 and the burner's circular outer wall 170. Flue products, after leaving the area of the burner head flow downward inside the burner circular inner wall 122 and also flow downward about the burner outer circular wall 170. Heat is transferred from the flue products, through the two circular walls to obtain the recuperative effect.

The bottom surface of the burner 20 connects the two circular walls and allows the flue products that flow down through the center of the inner circular wall to flow under the bottom surface of the burner and join with the flue products that flow downward about the burner outer circular wall. The flue products then flow through the vent outlet 155. Insulation prevents any significant transfer of heat from the flue products into the kitchen.

For faster cooking, a larger BTU/hr burner is required and a greater flow of radiant energy through a given area of ceramic glass is also required. Although the selective emissions from the burner of this invention transmit 78% of the radiant energy through the glass. The other 22% of the energy and heat in combustion products tends to heat the glass. For high rates of cooking it may be desirable to air cool the glass to permit maximum transmission of radiant energy without exceeding the limiting temperature of the glass.

Figure 7:
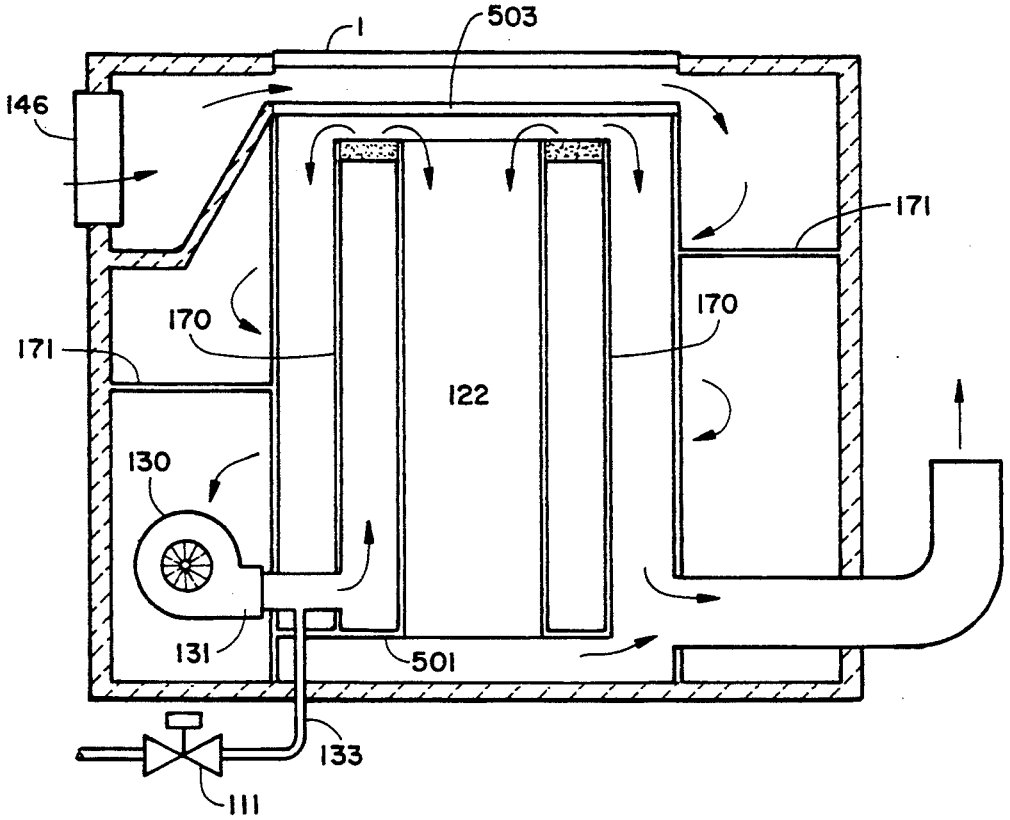
FIG. 7 Is a similar arrangement to FIG. 6 except that air cooling of the glass is provided along with an air filter and preheating of air by the flue products before the air enters the blower.

In the embodiment of the invention illustrated in FIG. 7, room temperature combustion air is utilized to cool the glass. Room air first passes through filter 146 and then enters an air passage consisting of the ceramic glass 10 as the upper surface and a quartz panel 503 as the lower surface. In this manner the incoming air cools the ceramic glass 10 so that its limiting temperature is not exceeded. The quartz panel 503 is not damaged by excessive temperature.

The air is then directed by horizontal baffles 171 about the outer surface of the flue products conduit 170 where it is preheated by the flue products flowing through the flue products conduit. The air then enters the blower 130 and the subsequent flow of flue products and air-gas mixture is effectively the same as described for FIG. 6.

Figure 8:
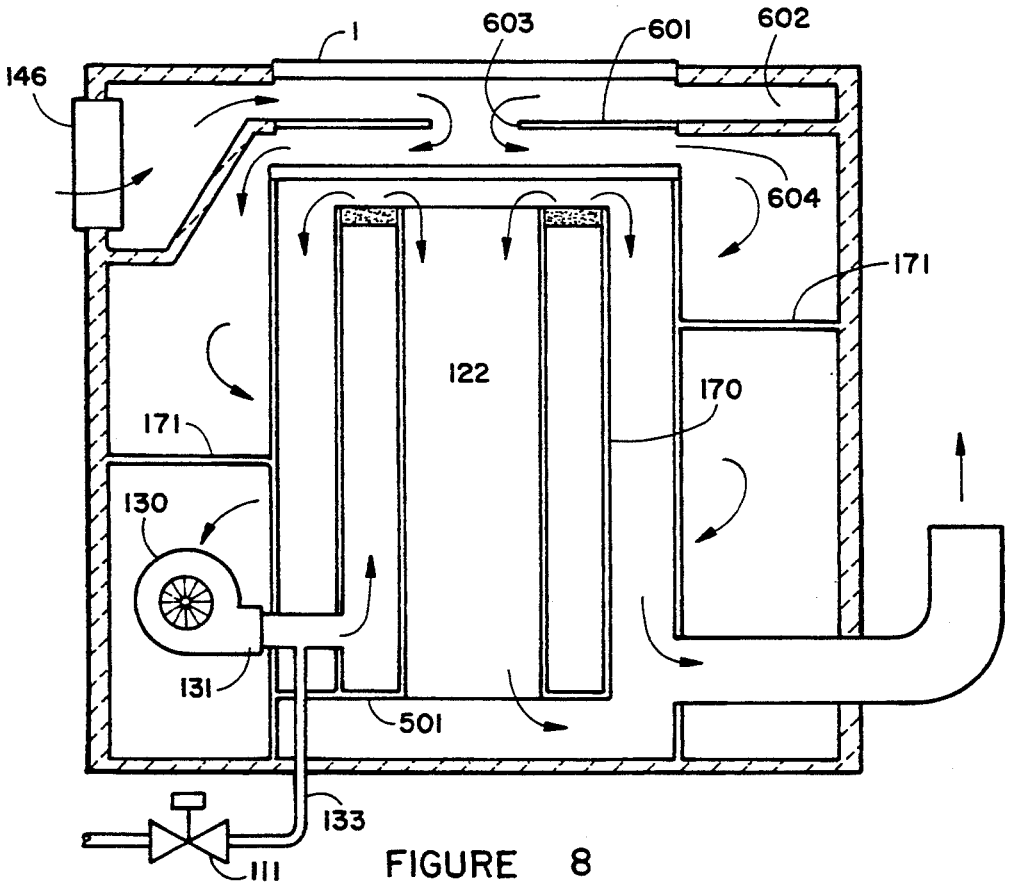
FIG. 8 illustrates an embodiment similar to FIG. 7 except that maximum air cooling is attained by allowing combustion air to enter along the entire perimeter of the ceramic glass.

FIG. 8 illustrates an arrangement identical to that of FIG. 7 except that an additional quartz disc 601 is positioned above the quartz disc 503 of FIG. 7. This upper disc has a large hole 603 in its center to permit flow of air in a downward direction. Air for cooling the ceramic glass enters about the entire outer perimeter of the glass 10 for providing maximum cooling, flows inward between the ceramic glass and the upper quartz disc 601 and then down through the hole 603 in the disc and into the space 604 between the upper and lower quartz discs. The air then follows the same path as described for FIG. 7.

Preheating the gas-air mixture is desirable from the standpoint of increasing the selective radiation of a burner. However, excessive preheating of the air-gas mixture may result in a flashback in which flame from upper surface of the burner head penetrates the porous burner head fiber matrix and ignites the gas fuel mixture and ignites the gas-air mixture within the burner head. This is an extremely undesirable situation as combustion within the burner head will in time overheat and destroy the burner.

Figure 9:
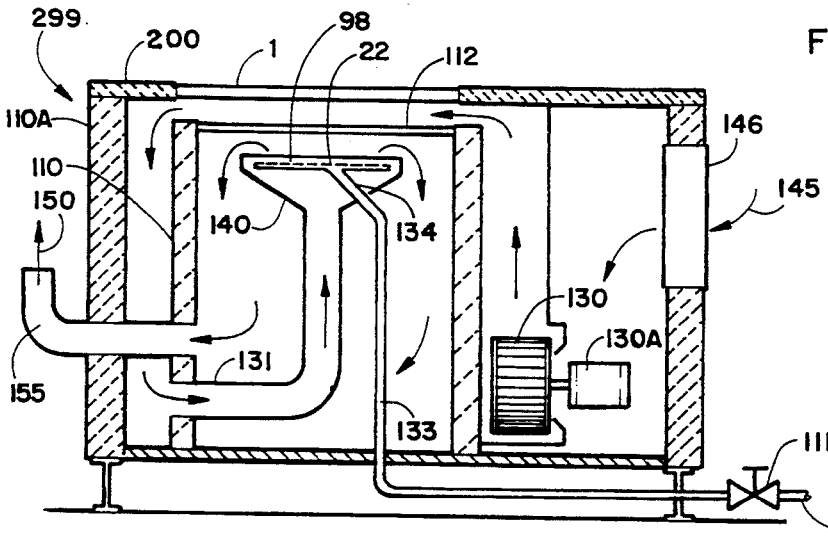
FIG. 9 Is a further embodiment of this invention in which the principle of fuel injection at or near the desired point of combustion is utilized to prevent flashback.

To prevent this flashback, the preheated air and preheated gas are kept separate and the gas is injected into the air at approximately the point of combustion. The concept is implemented in the arrangement of FIG. 9 by means of gas line 133 passing through the combustion product chamber and terminating in burner head 140 where it connects to an internal gas distribution tube 98. The gas flowing through the gas line is heated by the flue products about gas distribution tube and is injected through holes in the gas distribution tube(s) 98 directly in the burner head fiber matrix 22.

The combustion air passes through filter 146 and flows to a blower. This air (not preheated) is discharged by the blower 130 into a conduit 132 that connects with a passageway that consists of the ceramic glass 10 as the top surface and a quartz disc 112 as the bottom surface. The flow of air through this passageway cools the ceramic glass surface 10. The air then flows downward and enters recuperator tube 131 and then the burner inlet where it is heated by the combustion products flowing through the combustion product chamber, which be can further enhanced by a more elaborate heater exchange arrangement. The flue products are then expelled through vent connection 155. In this manner maximum preheating of air and gas ia attained without burner flashback.

Figure 10:
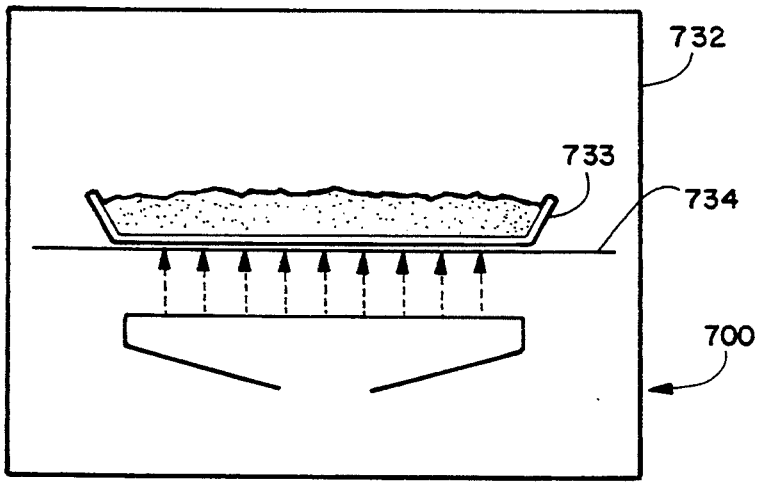
FIG. 10 Illustrates schematically application of burner-recuperation arrangements of FIGS. 3 through 9 to an oven with the burner positioned to provide selective radiation in the upward direction.
Figure 11:
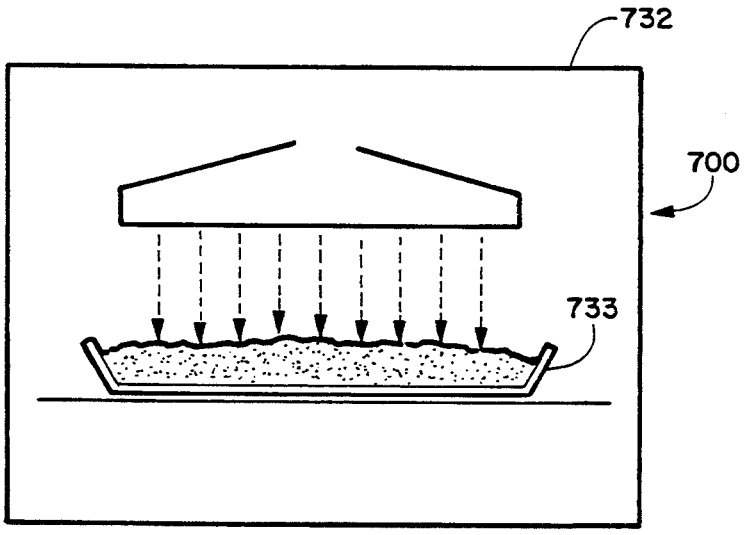
FIG. 11 Is similar to FIG. 10 except that the burner is inverted to provide radiation in the downward direction.

FIGS. 10 & 11 are oven 700 arrangements in which any combination of burner and recuperative system depicted in FIGS. 3 through 9 is installed. In FIG. 10 the burner 140 is positioned to provide the selective radiation in an upward direction, through the base of a tray 733 and into the food located on the tray, supported by gridbars 734. FIG. 11 shows the burner 140 in an inverted position to permit direct radiation from the burner to the food.

Both FIGS. 10 & 11 are especially applicable to commercial cooking as the time required to cook is greatly reduced, as compared to a conventional oven, due to selective radiation which is absorbed selectively by the food.

Figure 12:
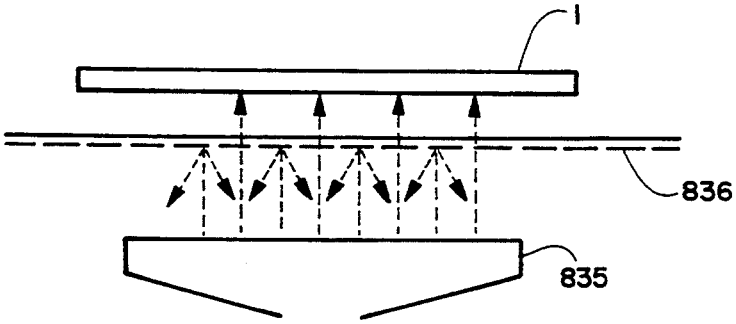
FIG. 12 Is a variation of the basic invention in which selective radiation through ceramic glass is attained by coating the glass with a material that reflects other than desired wavelengths and attains selective radiation from a black body radiating burner.

FIG. 12 illustrates a variation of the basic invention in which a conventional black body radiating burner 835 is positioned under a continuous ceramic glass top 10. Burners of this type, such as the all metal burner described in U.S. Pat. No. 4,597,734 of McCausland et. al., emit radiation of broad band wavelengths. The variation of this invention consists of coating the underside of ceramic glass with a specific material 836 that only permits penetration by the selected narrow band wavelengths that can readily be absorbed by water and the food to be cooked. Other wavelengths are reflected back toward the burner and their energy is primarily utilized for recuperation.

In this manner, the coating acts as a filter to permit only selected radiation to penetrate the ceramic glass.

What is claimed is:

1. A gas fired stove comprising:

a gas combustion burner including an emitting material that emits radiation in a narrow wavelength band;

means for supplying gas and air to the burner for combustion and heating of the emitting material to a temperature where narrow band emission occurs; and a cooking top adjacent to the burner transparent to at least a band of radiation corresponding to the narrow band of radiation emitted by the burner.

2. A stove as recited in claim 1 wherein the burner comprises a porous fiber matrix having means for supplying gas and air to a face of the matrix remote from the cooking top.

3. A stove as recited in claim 1 further comprising a cooking vessel having at least a portion that is transparent to the narrow band of radiation emitted by the burner.

4. A stove as recited in claim 1 wherein the emitting material is selected from the group consisting of zirconium, yttrium, ytterbium, holmium, thulium, cerium or thorium oxide fibers, and thorium-holmium, aluminum ytterbium-yttrium mixed oxide fibers, and mixtures thereof, and other materials that emit radiation by an inner electron shell transition.

5. A stove as recited in claim 1 further comprising a vent for preventing combustion products from the burner from entering living space adjacent to the stove.

6. A stove as recited in claim 1 further comprising recuperator means for preheating combustion air.

7. A stove as recited in claim 1 further comprising recuperator means for preheating combustion gas.

8. A stove as recited in claim 1 further comprising means for circulating combustion air adjacent to the cooking top before the burner for cooling the cooking top.

9. A stove as recited in claim 1 further comprising a transparent sheet between the burner and the cooking top.

10. A stove as recited in claim 1 further comprising means for introducing air to an edge of a space between the cooking top and the burner for cooling the cooking top.

11. A stove as recited in claim 1 further comprising a recuperator for heat exchange between flue gas from the burner and at least combustion air before it enters the burner for preheating combustion air.

12. A stove as recited in claim 11 further comprising a recuperator for heat exchange between flue gas from the burner and at least combustion gas before it enters the burner for preheating combustion gas.

13. A gas fired stove comprising:

a porous matrix burner including an emitting material on at least its outer surface that emits radiation in a narrow wavelength band;

means for supplying gas and air to the porous matrix burner for combustion in the porous matrix; and a cooking top adjacent to the burner transparent to at least a band of radiation corresponding to the narrow band of radiation emitted by the burner.

14. A stove as recited in claim 13 wherein the emitting material is selected from the group consisting of zirconium, yttrium, ytterbium, holmium, thulium, cerium or thorium oxide fibers, and thorium-holmium, aluminum ytterbium-yttrium mixed oxide fibers, and mixtures thereof, and other materials that emit radiation by an inner electron shell transition.

15. A stove as recited in claim 13 further comprising a vent for preventing combustion products from the burner from entering living space adjacent to the stove.

16. A stove as recited in claim 13 further comprising recuperator means for preheating combustion air.

17. A stove as recited in claim 13 further comprising a cooking vessel having at least a portion that is transparent to the narrow band of radiation emitted by the burner.

18. A stove as recited in claim 13 further comprising means for circulating combustion air adjacent to the cooking top before the burner for cooling the cooking top.

19. A stove as recited in claim 13 further comprising a transparent sheet between the burner and the cooking top.

20. A gas fired stove comprising:

a gas combustion burner including an emitting material that emits radiation in a narrow wavelength band;

means for supplying gas and air to the burner for combustion and heating of the emitting material to a temperature where narrow band emission occurs;

a cooking vessel having at least a portion that is transparent to the narrow band of radiation emitted by the burner; and means for supporting the cooking vessel adjacent to the burner.

21. A stove as recited in claim 20 wherein the burner is above the means for supporting the cooking vessel.

22. A stove as recited in claim 20 wherein the burner comprises a porous fiber matrix having means for supplying gas and air to a face of the matrix remote from the means for supporting the cooking vessel.

23. A stove as recited in claim 20 wherein the emitting material is selected from the group consisting of zirconium, yttrium, ytterbium, holmium, thulium, cerium or thorium oxide fibers, and thorium-holmium, aluminum ytterbium-yttrium mixed oxide fibers, and mixtures thereof, and other materials that emit radiation by an inner electron shell transition.

24. A stove as recited in claim 20 further comprising means for introducing air to an edge of a space between the cooking top and the burner for cooling the cooking top.

25. A stove as recited in claim 20 further comprising a recuperator for heat exchange between flue gas from the burner and at least combustion air before it enters the burner for preheating combustion air.

26. A stove as recited in claim 25 further comprising a recuperator for heat exchange between flue gas from the burner and at least combustion gas before it enters the burner for preheating combustion gas.

27. A gas fired stove comprising:

a gas combustion burner that emits largely black body radiation;

filter means adjacent to the burner for transmitting a selected wavelength band of radiation from the burner and reflecting other wavelengths of radiation from the burner;

means for supplying gas and air to the burner for combustion and heating of the burner; and a cooking top adjacent to the burner which is transparent to at least a band of radiation corresponding to the band of radiation passed by the filter.

28. A stove as recited in claim 27 wherein the filter means comprises a coating on the cooking top.

29. A stove as recited in claim 27 wherein the filter means passes a selected band of radiation that can readily be absorbed by water and food to be cooked.

* * * * *